US007530545B2

(12) United States Patent
Gillespie et al.

(10) Patent No.: US 7,530,545 B2
(45) **Date of Patent: *May 12, 2009**

(54) CONCRETE SLAB FORM SYSTEM

(75) Inventors: Paul Gillespie, Mississauga (CA); Charles Wood, Mississauga (CA)

(73) Assignee: Gillespie Practical Technologies, Inc., Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/893,873

(22) Filed: Aug. 16, 2007

(65) Prior Publication Data

US 2008/0031686 A1 Feb. 7, 2008

Related U.S. Application Data

(62) Division of application No. 10/495,530, filed on Apr. 13, 2005.

(51) Int. Cl.
*E04G 25/00* (2006.01)

(52) U.S. Cl. ..... 249/210; 403/322.1

(58) Field of Classification Search ..... 403/321, 403/322.1, 324–326, 377, 379.4, 379.5, 109.1–109.3, 403/109.5, 109.7, 109.8, 327, 80; 249/210
See application file for complete search history.

(56) References Cited

U.S. PATENT DOCUMENTS

| | | | | |
|---|---|---|---|---|
| 1,907,877 | A | 5/1933 | Roos | |
| 3,784,151 | A * | 1/1974 | Steele | 249/18 |
| 3,870,268 | A * | 3/1975 | Larkin | 248/354.1 |
| 4,147,321 | A | 4/1979 | Gostling | |
| 4,467,993 | A * | 8/1984 | Markewitz et al. | 249/28 |
| 4,485,931 | A * | 12/1984 | Forster et al. | 213/4 |
| 4,752,057 | A | 6/1988 | Hagemes | |
| 5,160,109 | A * | 11/1992 | de Leeuw | 248/354.4 |
| 5,614,122 | A | 3/1997 | Schworer | |
| 5,651,914 | A * | 7/1997 | Schworer | 249/210 |
| 2002/0141204 | A1 * | 10/2002 | Gao | 362/570 |
| 2004/0075042 | A1 | 4/2004 | Bergaretxe | |
| 2004/0075043 | A1 * | 4/2004 | Arozena Bergaretxe | 249/210 |

FOREIGN PATENT DOCUMENTS

| | | |
|---|---|---|
| CA | 1172057 | 8/1984 |
| FR | 2760482 | 9/1998 |
| WO | WO 94/25705 | 10/1994 |
| WO | WO 02/084051 A1 | 10/2002 |

* cited by examiner

*Primary Examiner*—Daniel P Stodola
*Assistant Examiner*—Joshua T Kennedy
(74) *Attorney, Agent, or Firm*—Carter, DeLuca, Farrell and Schmidt, LLP

(57) ABSTRACT

A system of interconnecting structural components for supporting and forming suspended concrete slabs that allow removal of form panels without disturbing the slab support posts (shores). Additional features of the system accommodate changes in suspended slab thickness, horizontal slab dimensions that are not multiples of the basic component dimensions, slab edge cantilevered form panels, attachment to walls and remote manipulation of form panels from the floor below using an erection staff. The primary system components are panels, support posts, telescopic beams, adjustable hanger connections, wall hangers, wall beams, raking shore assemblies and erection/stripping staffs. Form panels are directly supported by the shores without the use of an intermediate member (usually a beam) that is common practice in the concrete forming industry. The system reduces the number of required components that in turn reduces the capital cost to the user and improves his labor efficiency and quality of the concrete surface.

14 Claims, 16 Drawing Sheets

19
1
2
10
19
5
19
72
4
9
8
18
1
4
6
7
18
72
2
10

2
10
19
5
19
4
9
72
8
18
1
4
6
7
18
72
2
10

CONCRETE SLAB FORM SYSTEM

This application is a divisional application of U.S. patent application Ser. No. 10/495,530 filed Apr. 13, 2005, which claims the benefits of and priority to International Patent Application Ser. No. PCT/CA03/01951, entitled "CONCRETE SLAB FORM SYSTEM"filed on Dec. 17, 2003and Canadian Patent Application Ser. No. 2,416,644, filed on Jan. 20, 2003. The entire contents of each application are hereby incorporated by reference in their entirety.

FIELD OF THE INVENTION

The present invention relates concrete slab form systems, commonly used for the floors of multi-story buildings, and more particularly to a "drop head" system of cooperating structural components that are used to support and form suspended concrete slabs.

BACKGROUND OF THE INVENTION

Historically, the concrete forming industry has generally relied on form/support systems that remain in place until the concrete has attained sufficient strength to support itself and construction loads applied from above. Depending on construction codes applicable to the jurisdiction in which construction is underway, the complete forming system may be required to remain in place up to seven days.

An alternative to the above that is sometimes utilized is, generally, referred to as a "drop head" system. This type of system allows removal of form components without disturbing the slab supporting components. Drop head, systems invariably rely on the use of a support component (shore) and a beam to receive and support the form panels. However, in the past, geometry constraints inherent to these systems required the form panels be smaller in length and width than the spacing of the support posts (shores). Otherwise the panels could not be removed, as they needed to be passed between the supporting posts.

Attempts to overcome this deficiency include U.S. Pat. No. 5,614,122 to Schworer and U.S. Pat. No. 1,907,877 to Roos. These references both teach a drop head system onto which a beam or panel can be mounted, thus allowing beam or panel widths equivalent to the spacing of shore posts. The Roos reference is particularly significant in that the inventor appears to have, set about to accomplish the same objectives as the present invention. However, Roos teaches the use of very different components that result in a system with reduced utility.

Specifically, neither of the above references addresses certain practical considerations that should be satisfied to allow maximum utilization of the advantages drop head systems provide. Such practical considerations include providing a means to conveniently accommodate changes in the thickness of the slab, a means to conveniently accommodate slab dimensions that are not exact multiples of standard panel sizes, a means to safely and conveniently erect and dismantle cantilevered slab edge form panels from below by rotation of the form panels, a means to attach form panels to walls to gain support and stability, and a means to remotely release the drop head.

Present concrete slab form systems sometimes use telescopic beams to support forms and form plywood over openings that cannot be filled by standard panels. However, one problem with these telescopic beams is that they tend to deflect excessively at mid span due to the clearances that must be built into the assemblies to permit telescopic action.

Mechanical compensating devices are often provided to overcome this deficiency. This requires appropriate adjustment by the crews using them, creating extra cost and labor.

A further problem with current telescopic beams is that they do not present a completely flush upper surface to receive form plywood or panels. This occurs because the telescopic action is provided by one member sliding into a second member, creating a difference in height of the upper surface equal to the thickness of the outer member. Correction of this deficiency can be accomplished by adding shims, which involves added time and labor.

A further deficiency with existing drop head systems is the accommodation of various slab thicknesses. It is common practice to leave the problem of changes in slab thickness up to the contractor to solve on site. This contractor typically has carpenters build single use forms in the areas affected, significantly impacting productivity, material cost, and labor cost.

Another shortcoming of existing systems is that form panels can be dislodged from the supporting shores by strong winds with disastrous results. These systems do not provide a means of positively tying all panels and support posts together in respect to horizontal displacement. Individual or multiple panels can be blown off the supporting shores, creating potential for harm to workers or damage to equipment.

To compensate for this deficiency, a number of stabilizing connections to fixed anchor points are generally installed, thereby holding the form panels in place. Canadian Patent No. 1 172 057 to Young teaches one such system. This again requires additional labor and equipment.

Another shortcoming of present drop head systems is that they usually require the application of hammer blows to remove wedges or to rotate drop bushings. This feature requires a workman to climb up close to the top of the support post, which in some cases can be 12-14 ft. (approximately 3.5-4.5 meters) above the slab that he is working from. This effort is time consuming and tiring that leads to reduced productivity.

In general, wedges employed in drop head systems must have relatively low slopes. Otherwise they could self-release when the supported concrete is being vibrated to remove air from the concrete mix. This low slope requires the use of a long wedge and considerable driving force to release the wedge under the weight of the concrete. Also, the significant extension of the wedge beyond the perimeter of the supporting post when it is released often interferes with the removal of form panels. Some prior art clearly describes the considerable complexity some inventors have resorted to remedy this problem. U.S. Pat. No. 4,147,321 to Gostling is a good example.

Even though wedges are commonly used as load release devices in concrete support posts (shores), they are not the only means employed. U.S. Pat. No. 4,752,057 to Hagemes, and assigned to Hunnebeck, and Canadian Patent No.2,138,795 to Jackson are examples of other approaches used to provide a quick release. One skilled in the art will easily recognized that these quick release devices require a considerable driving force to overcome the friction that is present to effect release as is the case with wedges. They both include the additional deficiency that at a point in their operating cycle the full supported concrete load is applied to a very small area, resulting in high wear and structural damage of the components.

U.S. Pat. No. 1,907,877 to Roos does not provide a remote means to release the panels, nor does it provide a means to safely hang and erect panels from below. This later deficiency is significant to the user. This reference presents a safety risk when the panel supports are rotated out of the way. At this point the panel is free to fall onto the workers below.

Further, in Roos, considerable cost is incurred to manufacture four wedge assemblies per post and considerable worker effort is expended to set and remove the four loose (chained) wedges located at the top of each support post.

U.S. Pat. No. 5,614,122 to Schworer and assigned to Peri requires use of an additional member, a panel support beam. The use of this member increases the system cost and the labor required to apply the system. The form panels are smaller than the nominal spacing of the support posts (this limitation is required to effect removal of the panels between the support posts). The use of a panel support beam and the use of panels smaller than support post spacing increase the number of components that are required to be handled by the workmen and negatively impact the concrete surface quality due to the long length of components interfaces that produce a visible mark in the surface of the concrete. Schworer does teach a means to remotely operate the "fall collar" that is located near the top of the supporting post and identified in the description of FIG. 9. Workmen are therefore required to use devices to climb up to the drop head when removing panels, as is the case with Roos.

A further deficiency in the prior art involves edges of slabs that cantilever out beyond supporting walls or columns. These edges challenge the form designer to provide a convenient and safe means of erecting and dismantling these forms. The form must extend beyond the edge to be formed in order to provide workers with a place to stand when pouring the concrete. Existing solutions are less than satisfactory to users due to component complexity and the potential exposure to accidental falls experienced by workmen.

A further deficiency in the prior art is that lateral stability of the completed, or partially completed, form assemblies is usually provided by the use of support posts (shores) fitted at the bottom with a three-legged assembly (tripod). These means do not provide sufficient stability to withstand high winds or accidental impact by equipment.

SUMMARY OF THE INVENTION

The present invention seeks to overcome the deficiencies of the prior art by configuring a slab forming system with a number of cooperating structural elements that allow use of the largest possible panel, minimize the number of parts in the system and provide a means for workmen standing on the slab below the one to be cast next, to erect and later remove panels after the slab has been cast.

The inventor has found that the provision of a form panel with cantilevered panel end rails and a downward extending leg fitted at each corner of the panel, the leg engaging a support cup attached to the support post, allows the panel to be safely hung in a vertical position from the support cups and subsequently be rotated into a generally horizontal position from below in preparation for concrete placement on the form. The function of the cantilevered panel end rails is further explained in the following paragraphs in which panel stripping is addressed.

Stripping (removal) of the foregoing form panels can be accommodated by inventing a means to lower the cups a relatively small amount (typically 1.50 to 1.75 inches, or about 38 to 44 mm) that does not suffer the drawbacks of conventional wedges and release mechanisms as previously discussed. A translating mechanical member supported on two or more support seats accomplishes this in the present invention.

The translating member provides two or more support elements that are connected to each other at an appropriate spacing. The support elements are placed between the load to be supported and the support seats. The interface between the support elements and their companion seats have matching slopes downward in the direction the translating member will move to release the load, although applications may be found where the seating surface is not sloped.

The translating member can take a number of forms and also be installed in a number of different orientations and still perform a release/load transfer function. The advantages of this invention are that the load is very substantially released before the area of contact between the support element and seat approaches those found with in some release mechanisms and the amount of translation required to effect full release (drop) is much less than that required for conventional wedges (much more compact).

The present invention creates a significant improvement by adding a latch mechanism to hold the translating member in place. This allows the slope of the interface to be increased between support elements and, respective seats to the point that the translating member will translate automatically under the action of the supported load when the latch is released. The geometry and effects of friction in this arrangement are such that only very light loads are needed to release the latch and thereby initiate release and lowering of the support post head (drop head). This feature readily accommodates remotes operation from the slab below.

Release of the latch allows the translating member to move to the released position, in turn allowing the panel to drop down after all four corners of the form panel have been released. The form panel legs can thus relocate in the support cups.

Each support cup only contains the panel leg on three sides. The side of the cup facing the support post is left open to allow the panel freedom to move horizontally when the opposite end of the panel is lifted sufficiently to clear the lip of the cup support at that end and the panel pushed toward the support posts at the opposite end. Moving the panel horizontally as described allows the end that has been lifted to move out over the support cup, after which the panel can be rotated into a vertical hanging position. The panel can then be removed by workmen and installed in a new casting position.

One skilled in the art will realized that at no time during the stripping sequence was the panel free to fall and that the workmen can, with the use of an erection/stripping staff, perform all operations from the slab below without resorting to the use of a climbing device to reach the drop head.

The present invention further preferably includes a cantilever panel end rail. This cantilever panel end rails provide the space necessary to permit horizontal movement of the panel required in the stripping sequence. One skilled in the art will however note that a cantilever panel end rail is not required if the form panel is dropped more than the thickness of the panel. However, panels are usually thicker than five inches, which would require a drop in excess of this amount. The use of a cantilever end rail allows the stripping sequence to proceed with a drop in the order of only one and one-half inches greatly reducing the size of the release mechanism and related slot in the support column. An added benefit of the reduced drop distance is the panel does not have an opportunity to fall free of the supporting cups.

The present invention further includes a shoulder, which is provided in the corner of the form panel that traps the form panel under the top plate of the support post such that it can't lift up free of the supporting post under high wind pressure and thereby eliminates the risk of panels coming loose in high winds.

The engagement of all panel legs in support cups ties all elements in the system laterally together so that only a few lateral anchors have to be provided by the contractor (usually the presence of concrete columns within the boundary of the slab form provides sufficient lateral support).

In some circumstances, concrete walls can be used to provide both vertical and horizontal support to the form panels as the panel assembly is being constructed and when the completed assembly is in use. This is ideal in that the panel assembly is very secure in terms of resisting lateral forces exerted in high winds. If the wall is also used for vertical support a number of support posts can be eliminated, reducing the cost of equipment and labor to handle them. Wall hanger brackets have been invented to provide vertical and lateral support and a wall beam invented that provides only lateral support.

The present invention provides wall hanger brackets in two configurations. One bracket design has a horizontal lip designed to fit over the top of the wall or fit into a preformed pocket. Two light duty screws driven into pre-drilled holes in the wall provide lateral support. The other bracket design does not have a horizontal lip and relies on a heavy-duty anchor bolt for vertical and lateral support. Use of one or the other is simply a question of user preference as the function is exactly the same in both cases.

The wall beam is configured to attach to the wall with light duty screws that provide lateral stability. Support cups on support posts (shores) engage shaped ends on the wall beam to provide vertical support to the wall beam. Use of the wall beam accommodates the use of standard support posts next to a wall and closes the gap that would otherwise exist between the first panel and the wall and at the same time ties the form panel assembly to the wall.

The present invention can further include an erection/stripping staff. This staff has been created with a head that provides dual functions: one to engage the panel for use when rotating panels into position or stripping and the other to release the drop head.

The side designed to engage the panel for panel rotation is generally a cone with a necked base. The cone shape aids staff engagement with the panel by insertion in strategically placed holes in the form panel. The necked portion keeps the staff engaged with the form panel as the panel is either translated or rotated.

The side of the erection staff head designed to release the drop head is basically a two pronged fork that reaches up on both sides of the translating member to contact the latch. An upward force can then be applied to lift the latch and release the translating member. A hook is also provided on the staff head to engage a downward extension on the translating member. In the event the translating member does not move sufficiently to provide full disengagement (drop) then the staff can be used as a pry to move the translating member to its fully disengaged position.

The present invention further includes a means to form openings that cannot be accommodated by standard sized panels by providing telescopic beams on which the workers fit plywood to the exact dimensions. The present telescopic beam overcomes the deficiencies of the prior art by automatically compensating for working clearances in the telescopic mechanism and simultaneously providing a positive beam camber (positive camber means the beam is higher in the center). The amount of camber automatically increases as the beam is telescoped out such that the beam will become essentially straight when it is loaded by wet concrete.

The telescopic beam is made from two sliding assemblies. In one embodiment these sliding assemblies are identical but one skilled in the art will realized that they do not have to be identical. These sliding assemblies cooperate in such a way that they mutually slide past each other to change the length of the telescopic beam they collectively form. Each sliding assembly is made up of a special purpose beam section, usually a channel shape but all other beam shapes could be employed. This beam section is fitted with a connector that cooperates with the mating sliding assembly. The connector is attached by a screw, adhesive, weld or other fastening device or method. The beam component and connector could also be constructed as one piece should that be economically viable.

Sliding assemblies, especially those used in the forming industry, require liberal operating clearance to accommodate concrete contamination, local damage, and manufacturing tolerances. Connectors are configured to accommodate these clearances and keep the combined sliding assemblies (telescopic beam) straight when placed in position. Connectors are configured with lips and shoulders that key into the opposite sliding assembly to keep the assemblies connected to each other.

It has been found that configuring the connectors such that they provided a small amount of clearance over-correction (typically 0.010 inches or 0.25 mm) creates a positive camber in the telescopic beam and this camber increases automatically as the telescopic beam is lengthened. This resulting positive camber approximately compensates for the increasing amount a conventional beam would deflect under concrete load as the unsupported span is increased.

The present invention further provides a means to conveniently accommodate changes in slab thickness, in which this means includes two cooperating elements. This change in slab thickness is, for example, often required adjacent to columns. One element is a support hook open from above and configured to receive one of a series of mating hooks on the second element (adjustable hanger) that are open on the downward side. The hooks on the second element (adjustable hanger) are normally spaced at regular intervals giving the user the opportunity to engage a specific hook that will drop the height of the second element corresponding to a required change in slab thickness.

These two elements can be effectively employed when they are made extensions of other form system components. The single support hook is normally provided as an extension on the bottom edge of form panels or the bottom edge of specialized beams. The adjustable hanger is usually fitted to the ends of form support beams such as the telescopic beams described previously. It can also be configured to work as a loose piece interposed between two members with suitable appurtenances. The loose piece can be configured with an extra hook or hooks to give the workman the capability to form even thicker slabs by engaging an upper hook. If the upper hook is located at a distance that is not equal to the hook spacing on the other side then use of the extra hook will make available an additional set of different slab thickness setting on the other side.

In some instances there are advantages to using a connector key to permit the installation of beams that are not telescopic.

Convenient and safe erection and support of panels at the edge of the slab many stories above a street below is a design challenge that has not been well addressed by prior art. The form panels have to cantilever out beyond the slab below because the workers need a working area about three feet wide beyond the edge of the slab under construction. Systems in use today invariably rely on the installation of horizontal beams that cantilever over the edge of the completed slab below to which panels are affixed. Anchoring of the inboard end of the beams required to prohibit tipping of the beams requires use of an attachment to the existing slab that works in tension. Such an attachment is difficult to economically and reliably establish.

The form panels used in this invention are designed to rotate about one edge into the forming position and similarly rotate about an edge when stripping. This feature readily accommodates the installation of form panels at cantilevered slab edges through the use of raking (not vertical) shore assemblies. The form panel that is to be installed in a cantilevered position is hung vertically (normal procedure) from support posts (shores) that are usually positioned two or more feet back from the edge of the completed slab. The raking shore, in a generally horizontal position, is then attached to the lower edge of the hanging form panel with pins that permit rotation. Workmen can then rotate the form panel into the pour position by simply pushing outward on the raking shore assembly without leaving the safety of the slab they are working from. The raking shore assembly is then attached to two pre-installed shoes that are only acted on by compression forces, unlike the prior art tension connections. The raking shore assembly acts as a safety barrier during both the sequence of erection and also when concrete is placed on the form panel.

The broad aspect of the present invention therefore is a concrete slab form system for concrete slabs, said form system comprising: at least one shore post, said shore post comprising: a top plate; a post member extending downwardly. from said top plate and supporting said top plate against the concrete slab; and a drop head movable about said post member from a first pouring position to a second released position, said drop head including a cup affixed thereto; and a locking means for locking said drop head in said first pouring position; and at least one panel, said panel comprising: a flat upper surface; a plurality of end rails; each of said end rails being affixed below an end of said upper surface; a plurality of side rails, each of said side rails being affixed below each side of said upper surface; a plurality of corner members, each corner member being affixed to a corner of said upper surface and each said corner member being affixed at a first end to one of said end rails and affixed at an opposite end to said first end to one of said side rails, said corner member forming a notch to accommodate one of said shore posts; and a plurality of legs, each leg extending downwardly from one of said corner members, wherein said plurality of legs are adapted to support said panel within said cups of said drop head.

A further broad aspect of the present invention is a panel for use in a system for forming concrete slabs, the system utilizing at least one said panels and at least one shore post, said panel comprising: a flat upper surface; a plurality of end rails, each of said end rails being affixed below an end of said upper surface; a plurality of side rails, each of said side rails being affixed below each side of said upper surface; a plurality of corner members, each corner member being affixed to a corner of said upper surface and each said corner member being affixed at a first end to one of said end rails and affixed at an opposite end to said first end to one of said side rails, said corner member forming a notch to accommodate one of said shore posts; and a plurality of legs, each leg extending downwardly from one of said corner members, wherein said plurality of legs are adapted to support said panel.

A still further broad aspect of the present invention is a locking mechanism for a drop head on a support shore said locking mechanism comprising: a translating member movably affixed within said shore, said translating member being movable between an engaged position and a disengaged position; a seat affixed to said shore below said translating member and adapted to support said translating member in said engaged position; and a latch for holding said translating member in said engaged position.

A still further broad aspect of the present invention is a wall hanger to support at least one panel in a concrete slab form system, said wall hanger comprising: a flat upper surface adapted to fit within said corner notch of said panel; a body member below said upper surface; an affixing means to affix said body member to a wall and a cup affixed to the lower end of said body member; wherein said wall hanger replaces one of said shore posts in said form system.

A still further broad aspect of the present invention is a telescopic beam for a concrete slab forming system, said telescoping beam comprising: a first sliding member, said first sliding member including a first channel in one-side thereof; a first connector affixed within said first channel, said first connector having a first upwardly extending flange and a first downwardly extending flange, said first downwardly extending flange being longer than said first upwardly extending flange; a second sliding member, said second sliding member including a second channel in one side thereof; and a second connector affixed to said second sliding member, said second connector having a second upwardly extending flange and a second downwardly extending flange, said second upwardly extending flange being longer than said second upwardly extending flange; wherein said first upwardly extending flange and said first downwardly extending flange fit within said second channel, and said second upwardly extending flange and said second downwardly extending flange fit within said first channel, thereby keeping said first sliding member adjacent to said second sliding member, and wherein said first upwardly projecting flange being longer than said second upwardly projecting flange and said first downwardly extending flange being shorter than said second downwardly extending flange creates a variable camber that increases as said first sliding member extends away from said second sliding member.

Still a further aspect of the present invention is a raking shore assembly for installing form systems, said raking shore assembly comprising: a telescopic member for rotating and holding said form system in place, said telescopic member being capable of extending to a length suitable for installing said form system horizontally; a mounting shoe affixed to a lower working surface; an affixing means for affixing said telescopic member to said mounting shoe; and a pivotal connection for connecting said telescopic member to said form system, wherein said telescopic member pivots said form system into place and said telescopic member is thereafter affixed to said mounting shoe.

A yet further broad aspect of the present invention is a staff for erecting and removing panels in a concrete slab form system utilizing drop head post shores, said staff comprising: a shaft; a manipulating head, said manipulating head comprising: a latch releasing means for releasing a latch on said drop head post shore; a head projection to apply releasing force to a translating member on said drop head post shore; and a gap between said latch releasing means and said head projection for affixing to said panel, whereby said staff can be used to erect and remove said panel.

A still further broad aspect of the present invention is a slab depth varying system for a concrete form system, said concrete form system including a primary form panel at a first elevation and a secondary form panel for concrete at a second elevation, said slab depth varying system comprising: a primary panel hook member, said primary panel hook member projecting upwardly; a slab depth varying component, said slab depth varying component comprising: at least one inner hook, each said inner hook projecting downwardly and adapted to be hooked to said primary panel hook member; and at least one outer hook, each said outer hook projecting upwardly; and a panel adaptor attachable to said secondary form panel, said panel adaptor including a downwardly projecting hook adapted to engage said at least one outer hook, wherein the position of said inner-hook with relation to said outer hook varies the slab depth.

BRIEF DESCRIPTION OF THE DRAWINGS

The present invention is better illustrated in the drawings, in which.

DESCRIPTION OF THE PREFERRED EMBODIMENT

Reference is now made to the drawings. As will be appreciated by one skilled in the art, each of the objects of the present invention can be independently applied to formwork and form support (shoring) applications. However, one way to realize maximum utility is to incorporate all of them into a single slab forming system. The following has therefore been prepared to illustrate use of these inventions mutually cooperating in a slab forming system.

Figure 1:
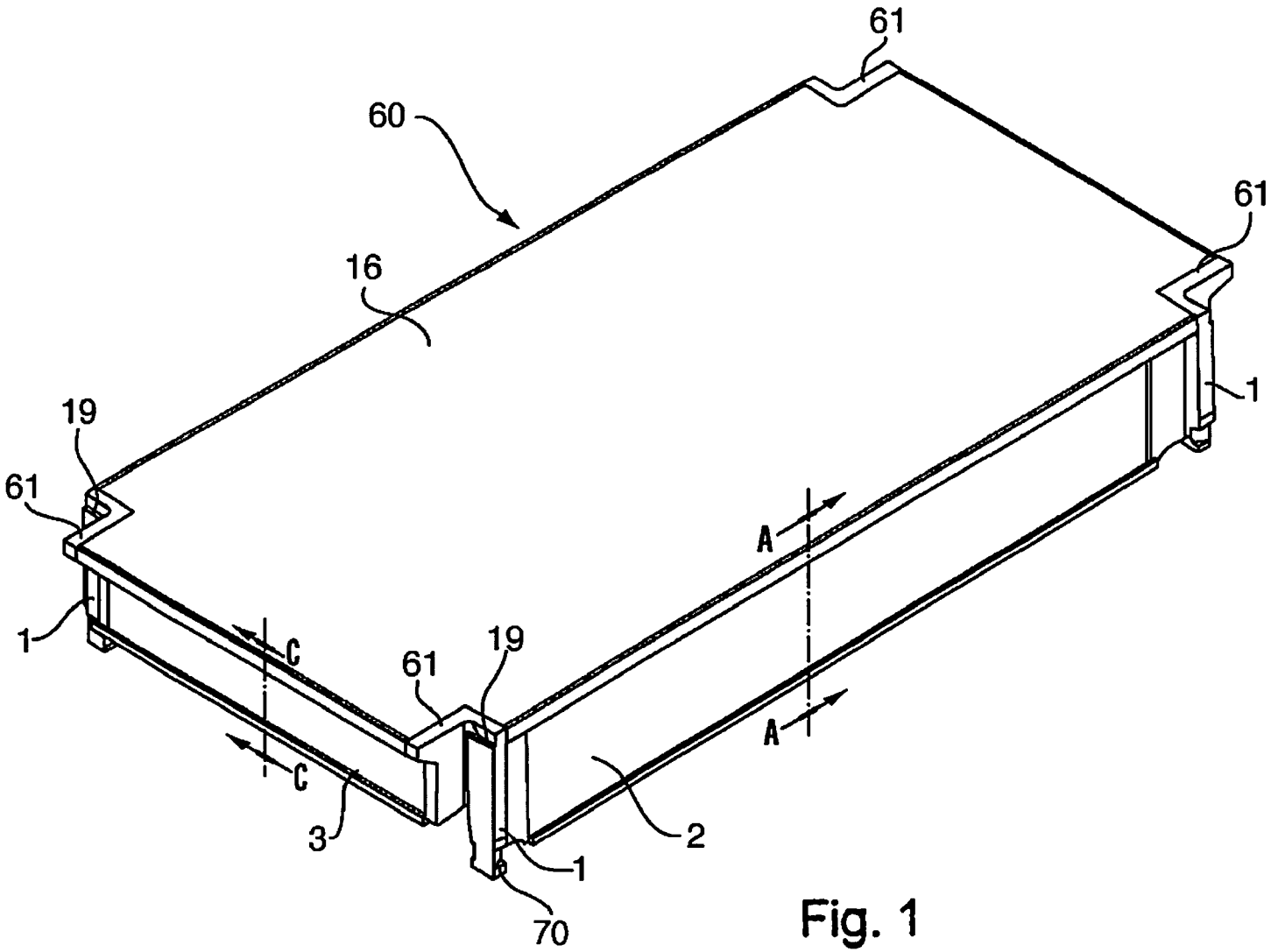
FIG. 1 is an isometric view of a typical form panel of the present invention.

The form panel 60 shown in FIG. 1 has one leg 1 at each corner that interfaces with a panel support means. As typically found in the forming industry, panel 60 is made with two structural side rails 2 and two end rails 3 along with a number of transverse ribs (not shown). The top surface 16 is usually plywood but other materials are also commonly used. Further detail of the panel is provided by sectional view A-A found in FIG. 2.

The corners of panel 60 include notch 62 to receive the head of the support posts (shores). A typical support cup 4 in FIG. 3 receives the bottom of the panel leg 1. In this instance, the end lip 66 of cup 4 has been notched downward to receive the side of form panel leg 1 that has been locally shaped to conform with notch 62 when form panel is hanging vertically. This provides a positive register of form panel 60 with cup 4 when it is being hung vertically and further ensures form panel 60 does not slip off horizontally. This is because the conforming shape of form panel leg 1 does not extend fully to the end of leg 1, thereby creating a foot 70 that cannot pass through notch 68 in end lip 66 of the cup. However, as one skilled in the art will realize, the detail shaping of the cup and interfacing surface on the leg is not inherently fundamental to the system in that a number of differently shaped interfaces could perform the same functions of positively locating and supporting the form panel leg 1 in both its vertical and horizontal positions.

Figure 4:
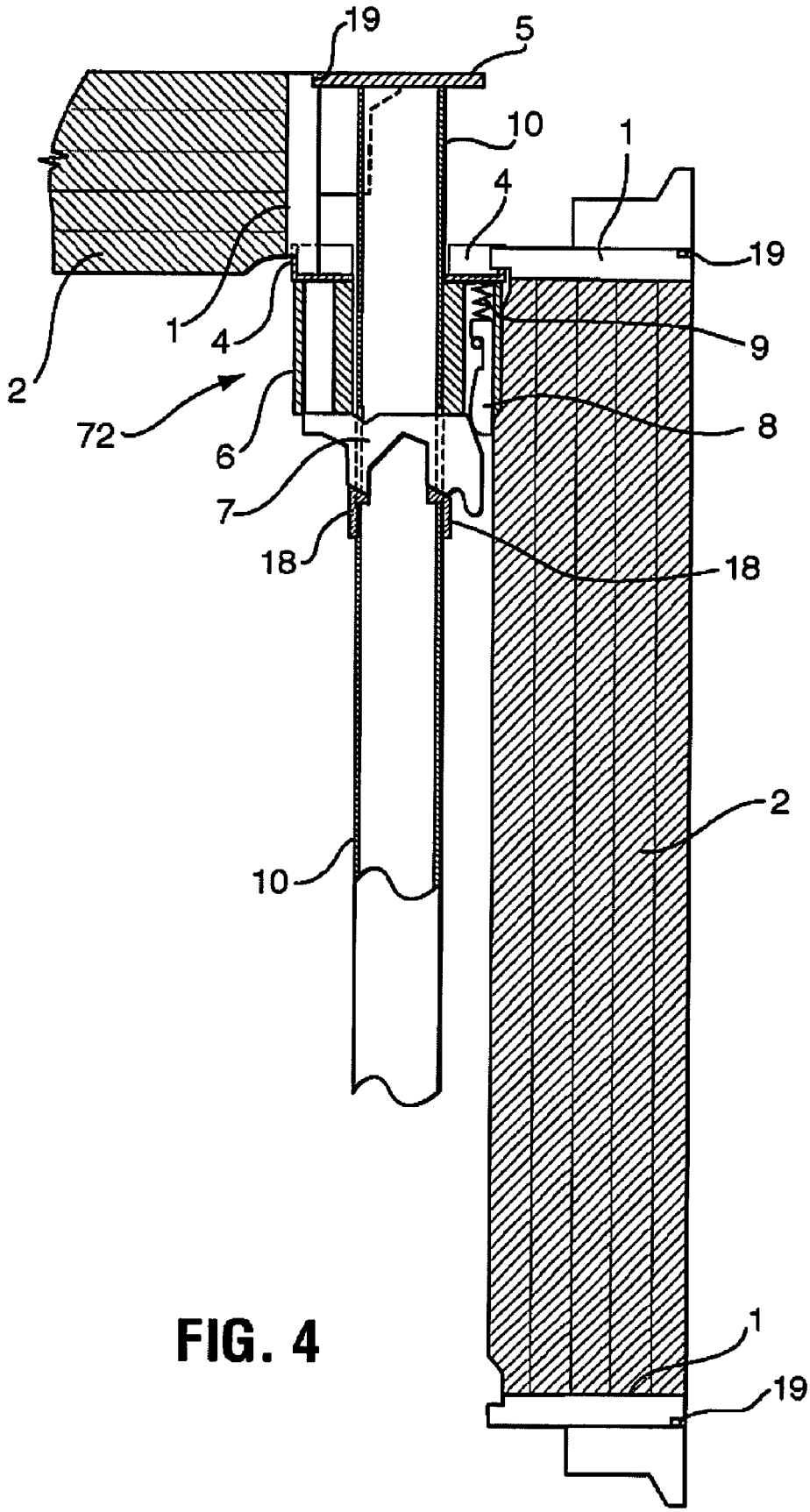
FIG. 4 is a sectional view of a shore post with a panel on the left side of the support post (shore) in the pouring position and on the right side a panel hanging vertically by a leg engaged in a support cup.

The position of form panel 60 and its legs 1 in support cups 4 are shown in FIG. 4 along with the supporting post elements. FIG. 4 is a section of the assembly through the centerline of the supporting post (shore). The form panel on the left is shown in the pour position and the form panel on the right in the vertical hanging position.

Support cups 4 are permanently attached to a sleeve 6 that is capable of sliding down support post 10. Sleeve 6 is supported by translating member 7, that is in turn is supported by two seats 18 permanently attached to a support post (shore). In a preferred embodiment, the interface between the translating member 7 and seats 18 is steeply sloped (typically 24 degrees with respect to the horizontal) such that load imposed by the poured concrete would automatically cause the translating member 7 to move. However, such motion is not allowed by latch 8 that must be lifted upward against a force provided by compression spring 9 to allow the translating member to move. While support post (shore) 10 is shown as a circular cylinder, one skilled in the art will appreciate that it could be a hollow member with different shapes such as rectangle, hexagon, or square.

One skilled in the art will also realize that the locking mechanism comprised of translating member 7 and seats 18 could be used in other areas of construction, including as a quick release mechanism for shores themselves or with shoring frames.

Figures 5, 6:
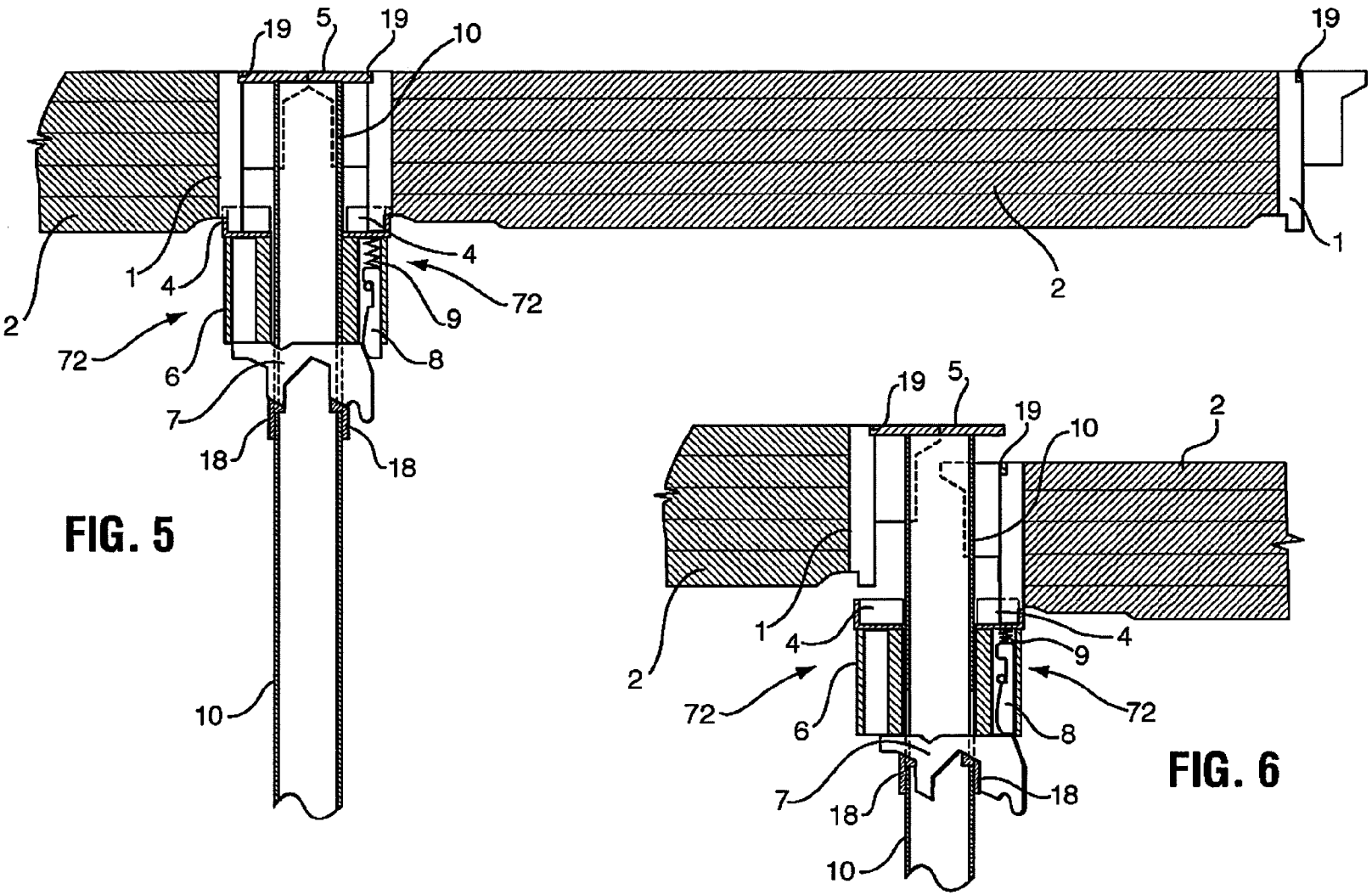
FIG. 5 is a sectional view of a shore post with both panels in the pouring position.
FIG. 6 is a sectional view of a shore post in which the translating component has been released and translated with the support cup and form panel dropped into the form panel stripping position.
Figure 15:
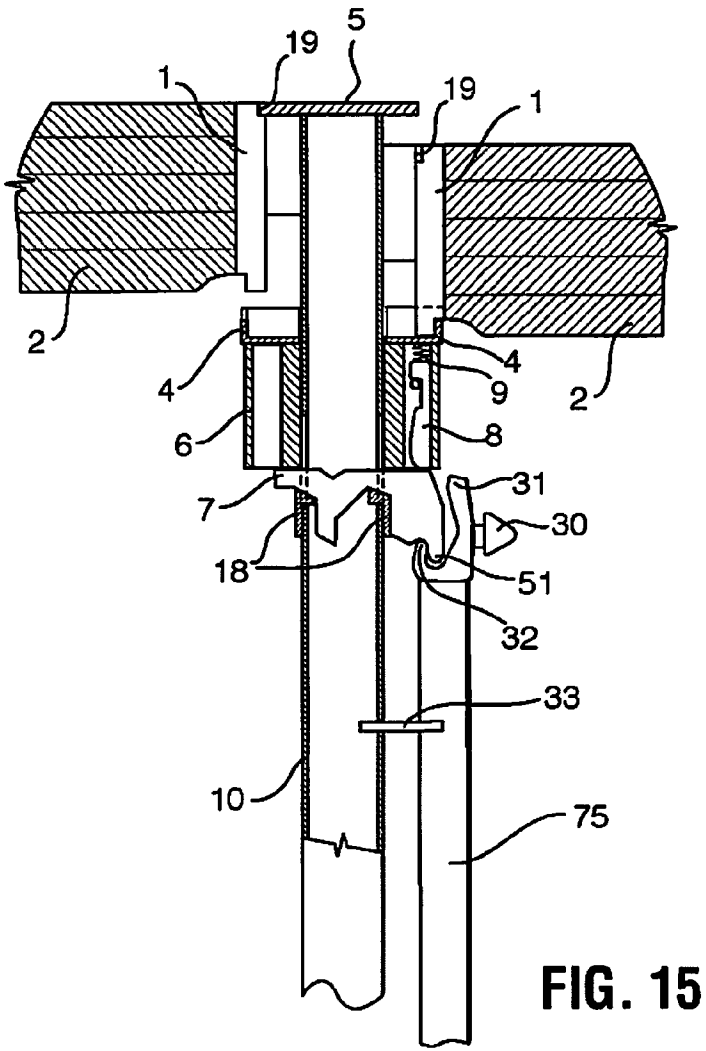
FIG. 15 is a sectional view of the present invention in which erection/stripping staff is rotated clockwise from FIG. 14 to "pry out" the translating member.
Figure 14:
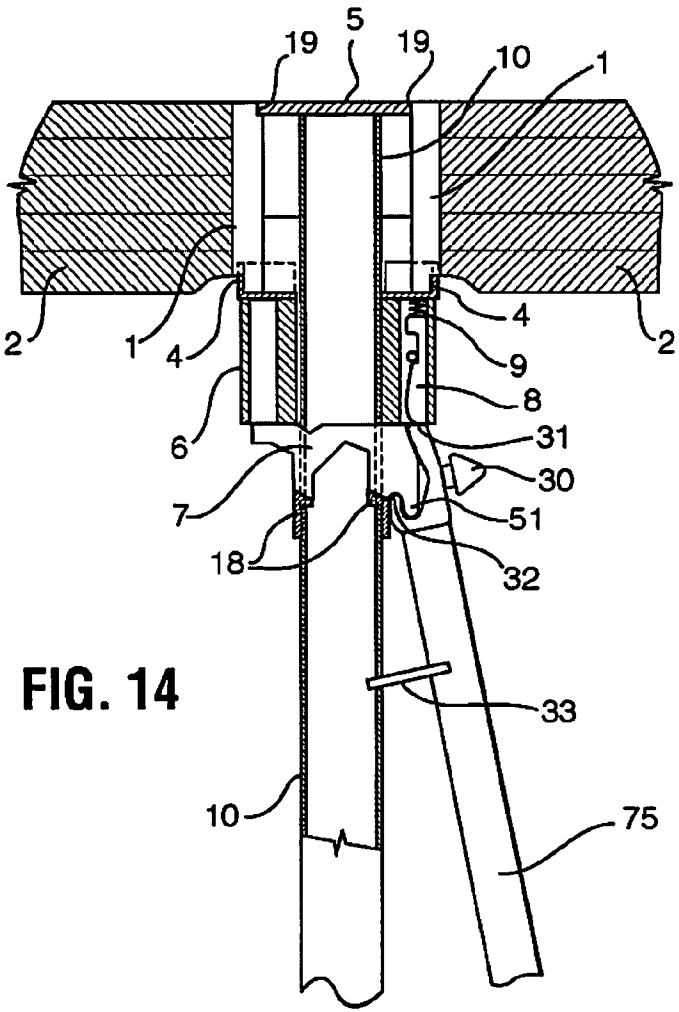
FIG. 14 is a sectional view of the present invention in which the forked head of the erection/stripping staff is in contact with the latch in the raised (released) position.

After the form panel is hung as shown on the right side of FIG. 4, erection of the form panel into the pouring position proceeds by rotating the form. panel into the horizontal, as best illustrated in FIG. 5, and holding it in this position by use of a temporary prop (erection staff) 75 (illustrated in FIGS. 14 and 15). Workmen can then install an adjacent form panel into the horizontal position using the same process after which a support post (shore) 10 fitted with cups 4 can be moved into place to engage the two legs 1 of adjacent panels 60 with cups 4. The foregoing process is repeated until all of panels 60 are in place to complete the slab form. Concrete placement can then begin.

When form panels 60 are installed in a horizontal position, shoulders 19 on each panel 60 are positioned under the top plate 5 of the support post (shore) keeping form panels captive 60 to support post (shore) 10 so that wind uplift cannot separate them.

After the placed concrete has had an opportunity to partially cure (gain some strength but not necessarily full strength) over a period of 24 hours or more the panel stripping procedure can commence. The workmen with the aid of an erection staff 75 release translating member 7 by pushing up on latch 8. This causes translating member 7 to move to the right into the released position as shown in, FIG. 6.

In FIG. 6, form panel 60 on the left is seemingly without a means of support. However, two forces exist to keep the left form panel against the underside of the poured slab. One is panel adhesion to the slab and the other is prying action at the extreme left end of the form, panel 60. This second force results because as the free right end of the form panel tries to drop by rotating about the contact point of legs 1 in cups 4 that have not been released, the extreme far left end of the form panel must move up. However this motion is prevented by the slab, thereby keeping form panel 60 horizontal. In some circumstances the prying action may not be present, such as near the edge of a slab. In this instance, the workmen will have to rely on the use of a temporary support (erection staff) 75 to keep the form panel 60 shown on the left in FIG. 6 in the horizontal position while the form panel 60 on the right is removed (stripped).

Figure 7:
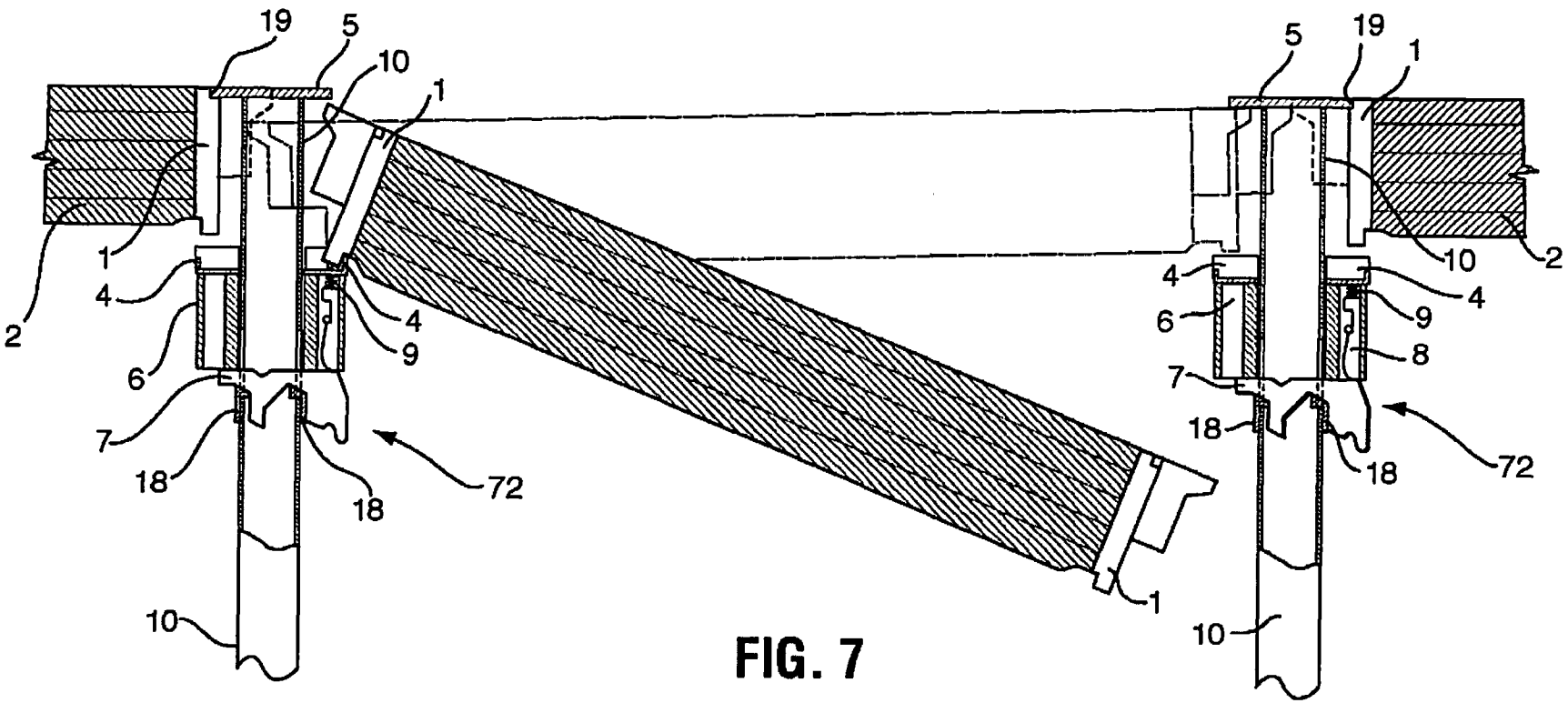
FIG. 7 is a three-position view of the panel depicting the required trajectory it must take to acquire the vertical position from which it can be easily removed for use in a new forming location.
Figure 11:
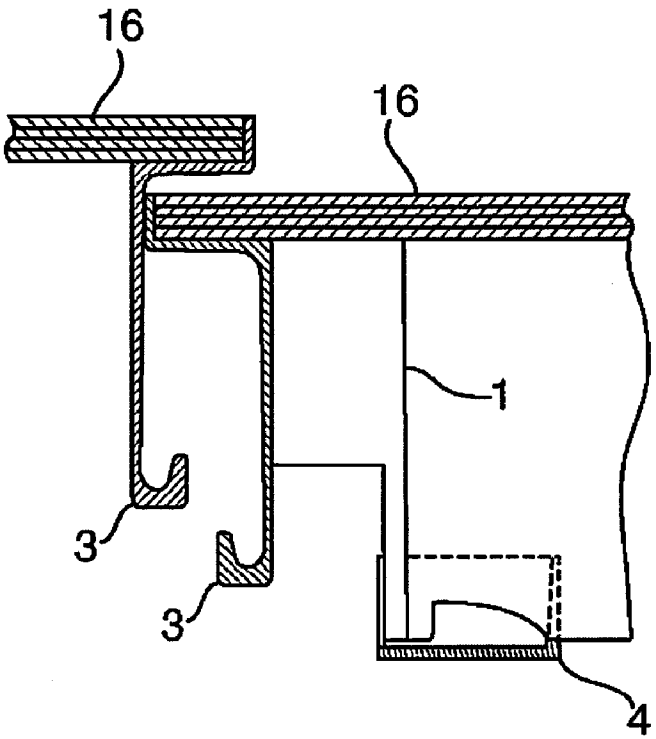
FIG. 11 is a sectional view along section: C in FIG. 1.

Form panel stripping proceeds by sequentially moving the form panel 60 as shown in FIG. 7. Position 1 shows the right end of the form panel 60 sufficiently raised to clear the lip 66 of the support cup 4 so it can be moved into Position 2, after which the free end is simply allowed to drop until the form panel 60 ultimately hangs in the vertical position ready for removal by work crews for use in a new form position. Movement of the form panel 60 from position 1 to position 3 is accomplished by a workman standing on the slab below using an erection staff 75. The cantilever panel end rail 2 provides the necessary space required to accommodate the foregoing lateral movement of panel 60 as it is being stripped. This feature is most clearly seen in FIG. 11.

Support posts (shores) 10 are removed when the slab has gained sufficient strength to be self-supporting and support any construction loads that may be imposed from above.

Figure 8:
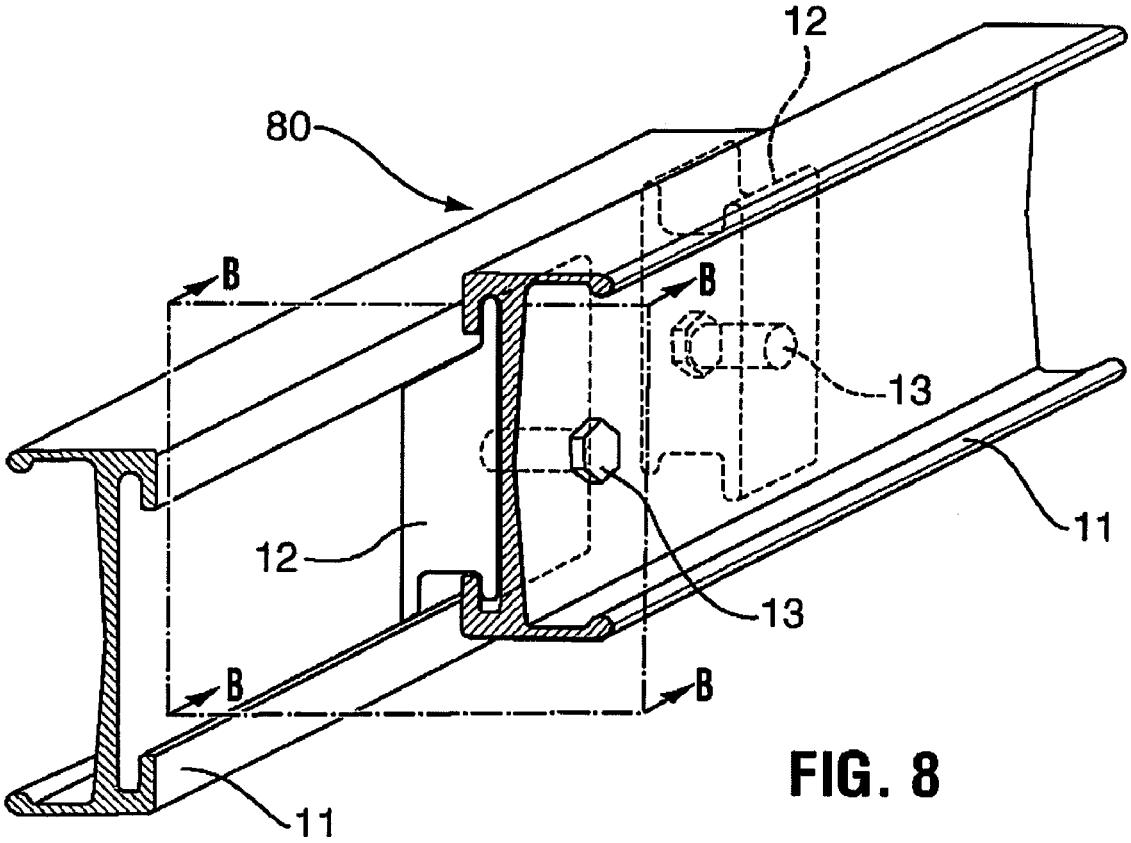
FIG. 8 is an isometric view of a telescopic beam showing engaged sliding assemblies with connectors.

Rarely are the required slab dimensions exact multiples of the standard form panel dimensions. Therefore some means is required to form remaining openings that are smaller than standard panel dimensions. The telescopic beam 80 as shown in FIG. 8 is used for this purpose. Sliding members 11 are simply pulled apart or pushed together axially until the required length is achieved and the telescopic beam 80 is placed onto its intended supports. The telescopic beam 80 will automatically have some positive camber that will be beneficial in keeping the underside (soffit) of the slab flat. Workmen can then custom cut plywood to the exact size required and attach it to the telescopic beams. Methods of attachment are well known in the art. In a preferred embodiment both assemblies (sliding member 11 with connector 12 attached) are identical. However, as indicated in the foregoing description, other configurations are possible.

Figure 9:
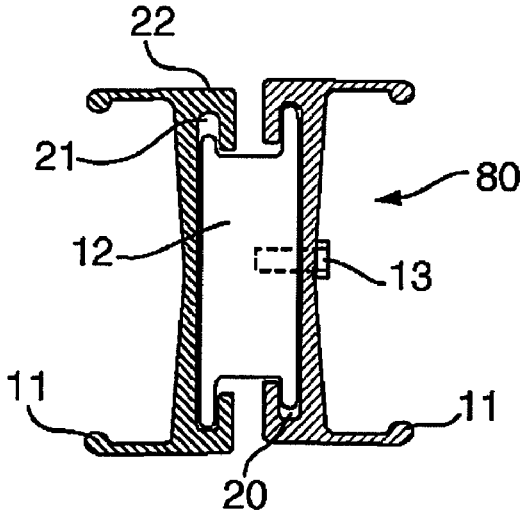
FIG. 9 is a sectional view along section B of FIG. 8.

The operating principal of the telescopic beam 80 in regard to the automatic generation of positive camber and elimination of the effects of operating clearance can be explained using FIG. 9. FIG. 9 shows the relative position of components when the beam 80 is under load. Vertical gaps 20, 21 and 22 are key to the proper functioning of the telescopic beam.

Gap 20 is the clearance provided to facilitate assembly of connector 12 into position at one end of sliding member 11 before the two are permanently fastened together with screw 13. Note that connector 12 is pushed up tight to contact the upper lip on sliding member 11 before screw 13 is driven and tightened.

Gap 21 is the total operating clearance that allows connector 12 to easily slide by the sliding member 11 on the left side of FIG. 9 when the length of the telescopic beam 80 is adjusted.

Dimension 22 (exaggerated in FIG. 9 for clarity) is usually in the order of 0.010 inches (approximately 0.25 mm). This difference in height produces automatic cambering of the telescopic beam. From a concrete finish perspective, this difference in height is inconsequential as the amount that form support beams deflect is usually 10 to 20 times greater. The geometry displayed in FIG. 9 causes the telescopic beam to assume greater positive camber as the telescopic beam is extended.

In some instances the telescopic beam 80 shown in FIG. 8 can be used as is. However, it is often convenient to fit (commonly by welding) a short piece of structural shape (typically 4 inches long) such as an angle or channel to each end to give the telescopic beam 80 some stability and a convenient surface to rest on supporting members or posts.

Figure 10:
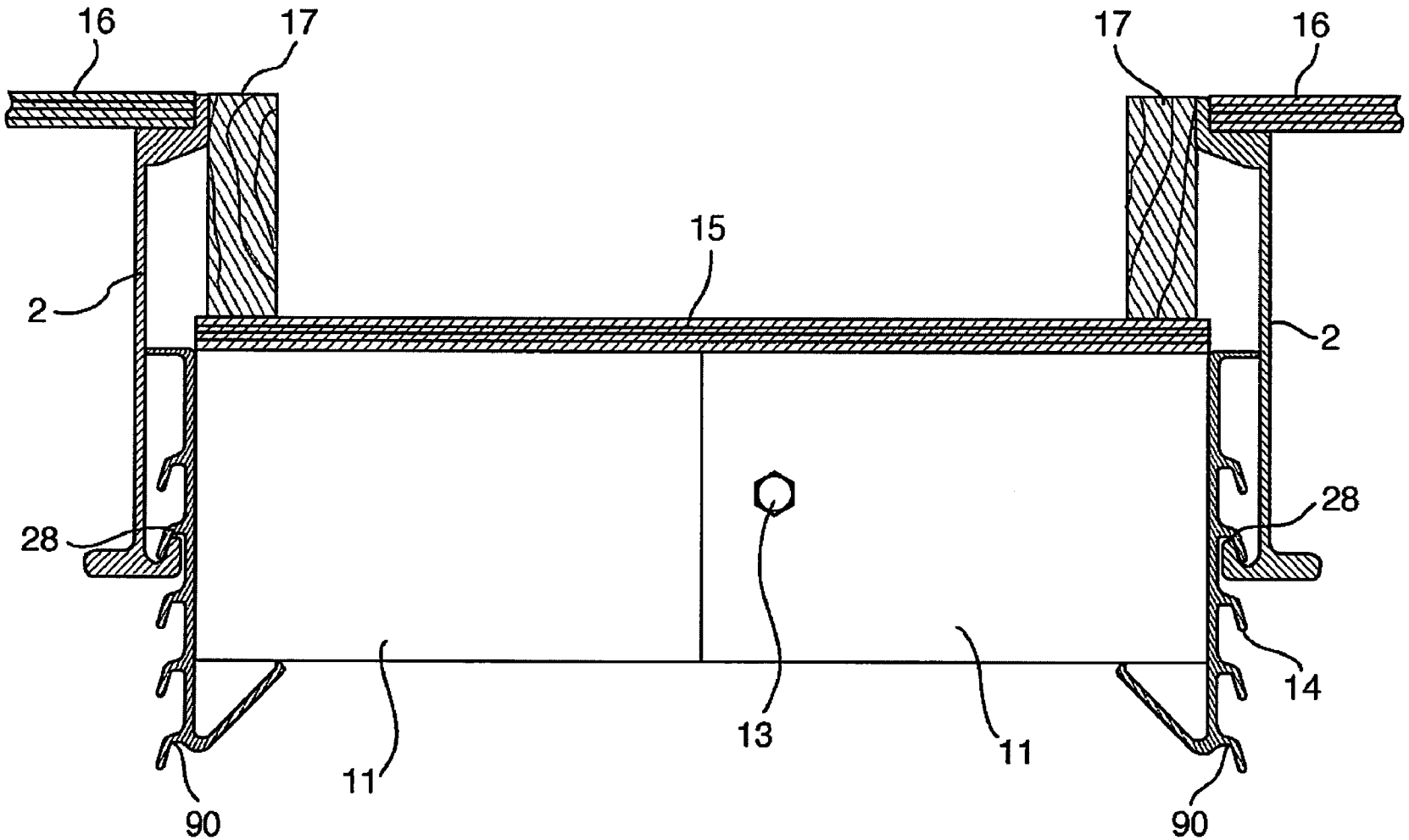
FIG. 10 is a sectional view of a form where the slab thickness is increased through use of a telescopic beam with an adjustable-hanger fitted at each end.

Reference is now made to FIG. 10. FIG. 10 is an example where a unique structural shape (adjustable hanger) is fitted to accommodate changes in slab thickness.

Concrete slabs often have to be cast thicker in the areas adjacent to concrete support columns, beams and walls. The inventor has developed component 14, illustrated in FIG. 10, to satisfy this requirement. As can be seen in FIG. 10, component 14 has a series of hooks 90 that can engage a supporting member at each end. By selecting the appropriate hook the worker can leave the slab thickness unchanged or choose to increase slab thickness nominally in inch increments. Surface 15, which in a preferred embodiment is made of plywood, and member 17, which is preferably wood, are custom sized to suit slab geometry requirements.

Figure 2:
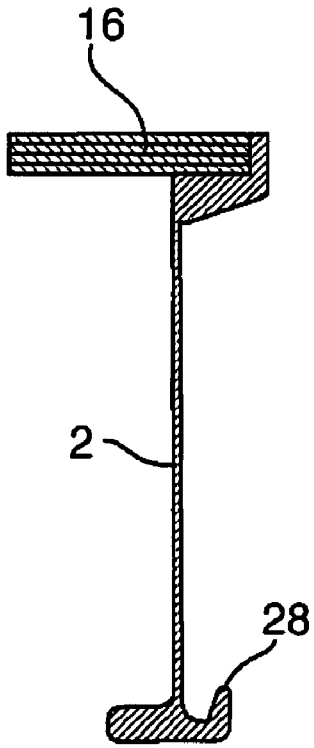
FIG. 2 is a sectional view of a panel side rail as identified in by section A in FIG. 1.
Figure 12:
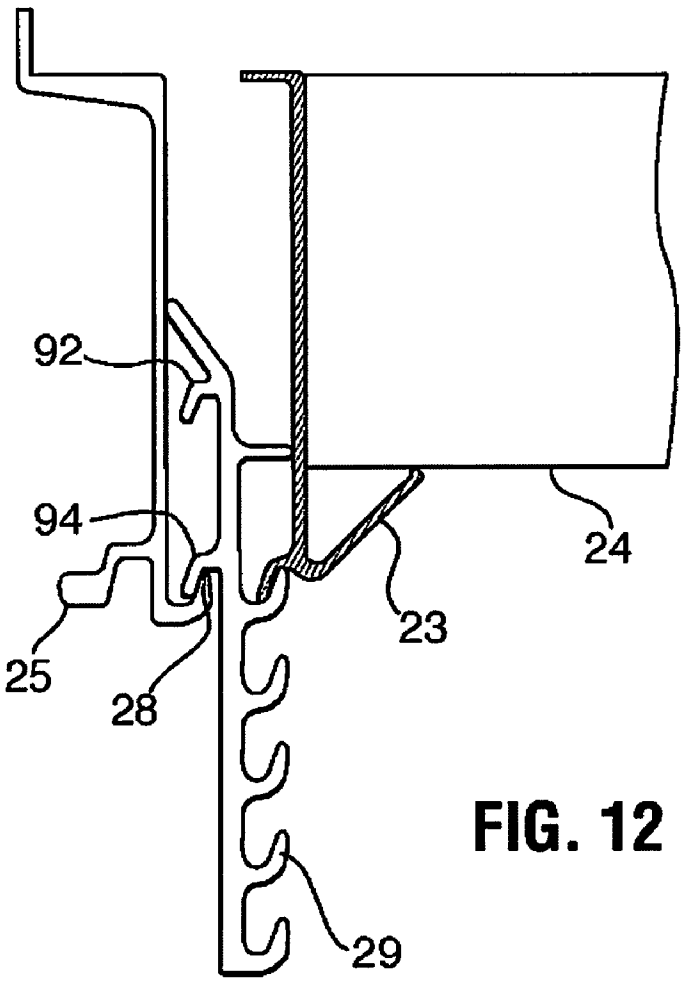
FIG. 12 is a sectional view of a loose adjustable hanger located at the junction of a support beam and a form support beam.

FIG. 10 shows components 14 fitted to a telescopic beam engaging the side 2 of a form panels 60 that has been fitted with hook 28 as shown in FIG. 2. This is one of a number of ways component 14 can be usefully employed. It can also be configured as a loose element 29 as shown in FIG. 12 to connect a secondary form support beam 24 that has a special adaptor 23 fitted to its ends to a primary support beam 25. Components 29 and 23 are just sufficiently long (in the order of 4 inches or approximately 10 cm) to give stability to the. secondary beam. In the embodiment illustrated in FIG. 12, loose element 29 is configured with two downwardly open hooks 92 and 94 on the left side. Use of the upper hook 92 increases the slab thickness that can be formed and/or may also allow a different set of slab thicknesses if the upper hook 92 is located at a distance above the bottom hook 94 that is not a even multiple of the hook spacing on the other side of loose element 29, a different set of slab thickness will result.

Figure 13:
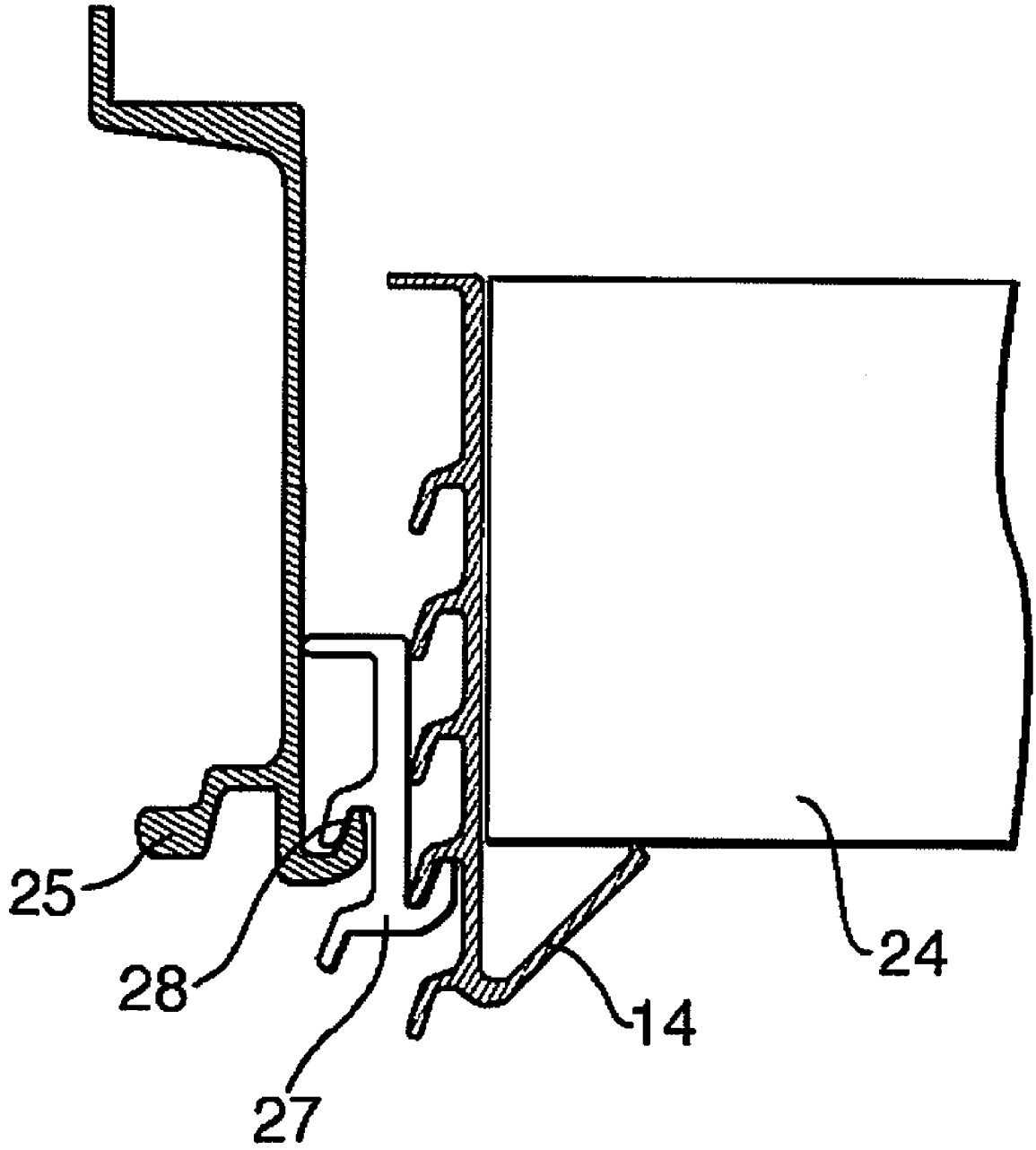
FIG. 13 is a sectional view showing the use of a connector key interposed between a support beam on the left and a form support beam.

In some instances it is beneficial to use a connector key 27 as shown in FIG. 13 to connect beams with a fixed length (non-telescopic). The length of connector key 27 is usually made the same length as component 14.

The erection/stripping staff 75 allows the user to manipulate form panels 60, and the support post (shore) drop head 72 remotely from the completed slab immediately below the slab that is under construction. FIG. 14 shows how the head 31 of the staff 75 contacts and lifts latch 8 to release translating member 7. The upward motion is immediately followed with rotation of the staff 75 toward the post depicted in FIG. 15. This rotary motion generates a prying force on the translating member 7 when staff 75 pivots about fulcrum 33 and head projection 32 engages the downward projection 51 extending from translating member 7. This prying action ensures translating member 7 moves to the drop position.

Staff 75 can be further utilized to rotate a panel 60 into or out of place using knob 30. Knob 30 is inserted into a hole in panel 60 and staff 75 can then be used by a worker on the slab below to rotate panel 60 up or down.

Figure 16:
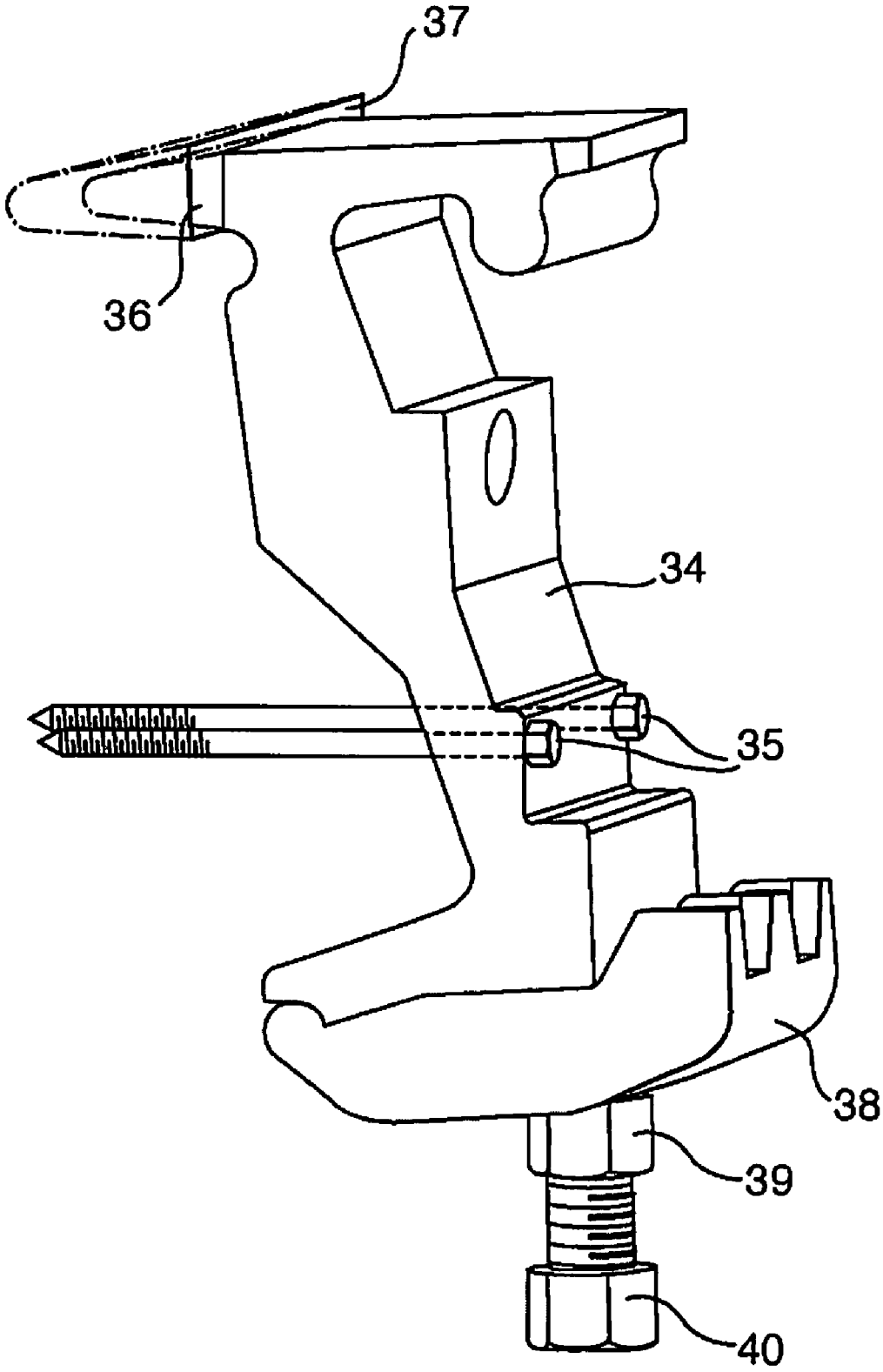
FIG. 16 is an isometric view of the wall hanger with a horizontal projection at the top designed to land on the top of a wall or sit in a pocket preformed in a wall.

Form panels and assemblies can be supported both laterally and vertically through use of a wall hanger 34 as shown in FIG. 16. Wall hanger 34 has a horizontally projecting lip 36 that engages a preformed pocket 37 in the wall to provide vertical support to the hanger. The horizontal lip can also rest on the top of a wall to perform the same function of vertically supporting the hanger. Lateral connection to the wall is by one or more screws 35 passing through the holes provided in hanger 34 and into the wall.

Figure 3:
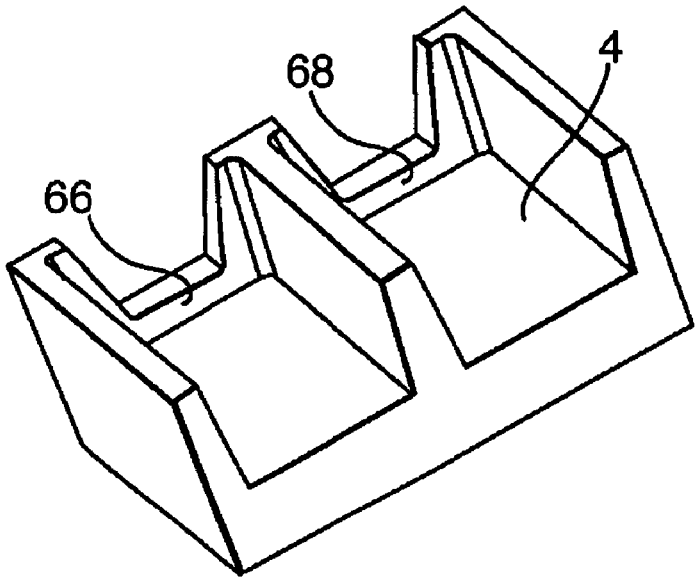
FIG. 3 is an isometric view of a typical support cup designed to receive legs from two adjacent panels.

Cup 38 in FIG. 16 is similarly configured to cup 4 in FIG. 3 with respect to its intended function to support and laterally contain panel legs 1. Cup 38 is vertically supported by nut 39, which is in turn supported by stationary screw 40. Nut 39 is rotated to raise the cup to support the form panel in the pour position and then allow stripping the form panel 60 by lowering the cup 38.

Figure 17:
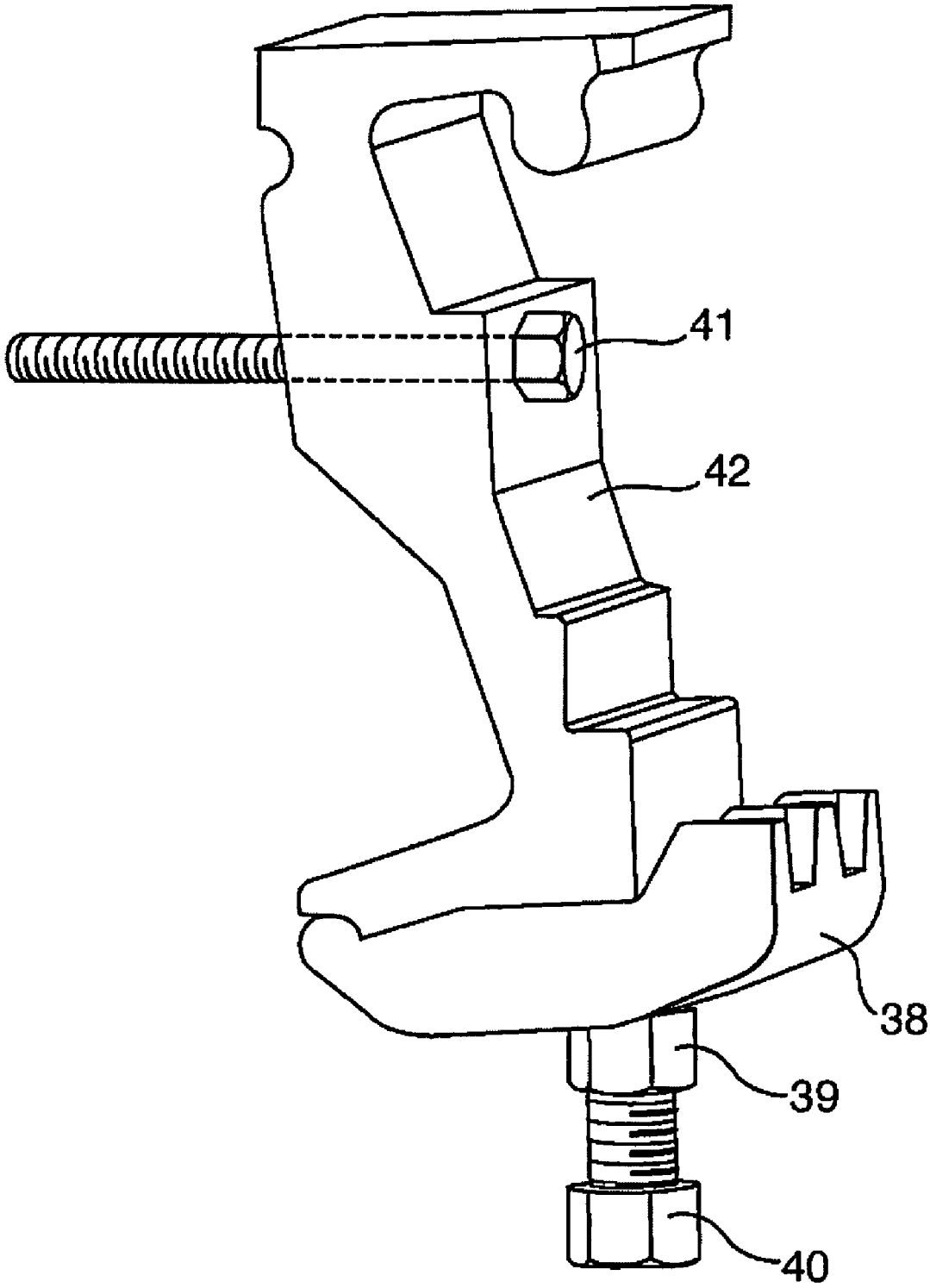
FIG. 17 is an isometric view of a wall hanger that relies on a heavy-duty anchor bolt for vertical and lateral support.

A second embodiment of a wall hanger is shown in FIG. 17. Wall hanger 42 does not have a horizontal lip and therefore must rely on a heavy-duty anchor bolt 41 for both vertical and horizontal support. Wall hanger 42 will most likely be employed by the builder when he cannot pre-form pockets in the wall or only needs a few supports to complete an installation.

Figure 21:
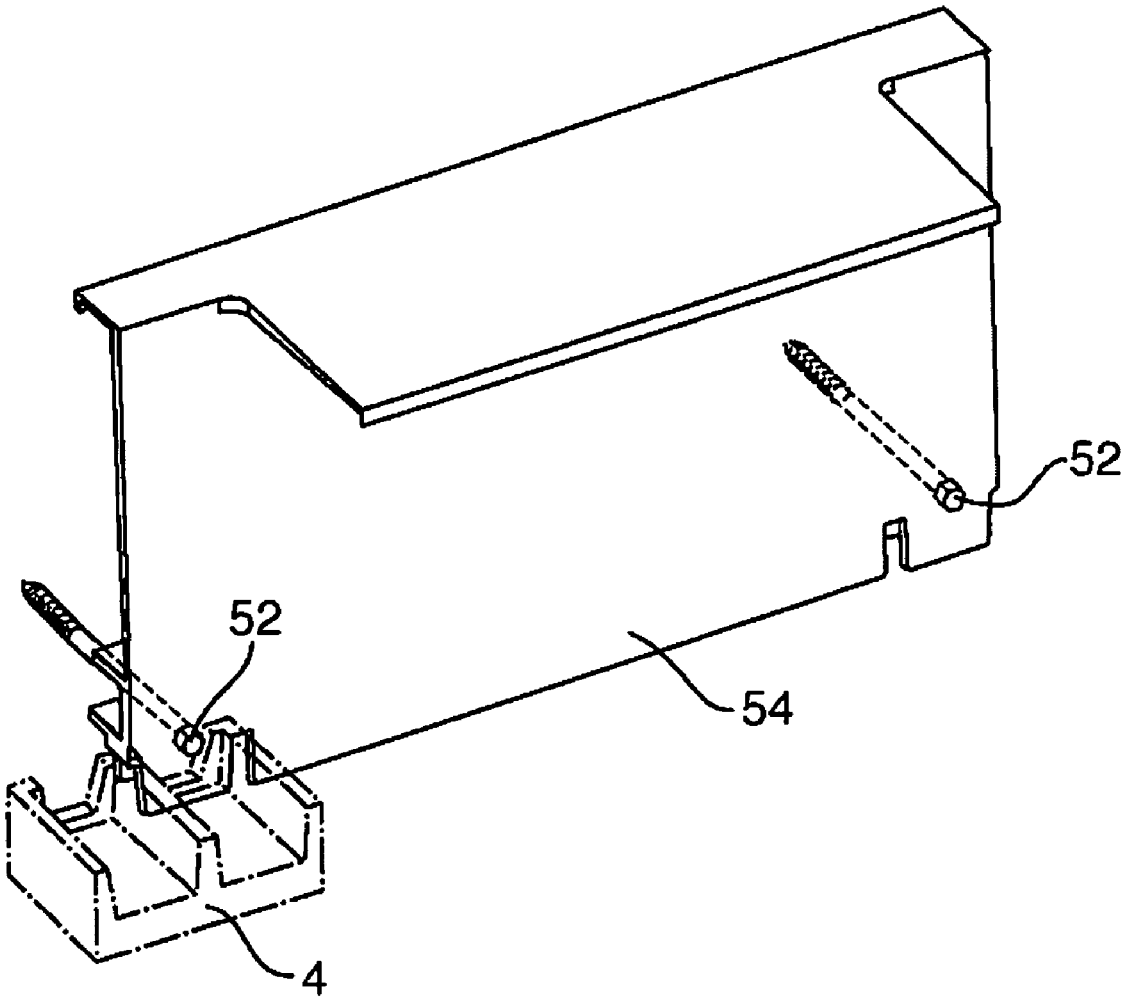
FIG. 21 an isometric view of the wall beam installed on a wall with the support cup on the support post (shore) shown dotted.

The foregoing wall hangers 34 and 42 require organization and labor on the part of the contractor to ensure the hangers are accurately placed and well attached to the supporting wall. Some contractors may find using a wall beam 54 as shown in FIG. 21 is a more convenient way to gain lateral stability for form panel assemblies. These wall beams provide automatic accurate lateral location on the wall in that they are designed to butt end to end along the wall. Light duty screws 52 hold the beam to the wall 53. The support posts (shores) 10 are installed to support cups 4 (shown by dashed lines in FIG. 21) engage wall beam 54. Support posts 10 provide two functions in this instance. First, they vertically support the wall beam. Second, they provide the lateral connection to the form panel assembly by way of the support cups 4.

Figure 18:
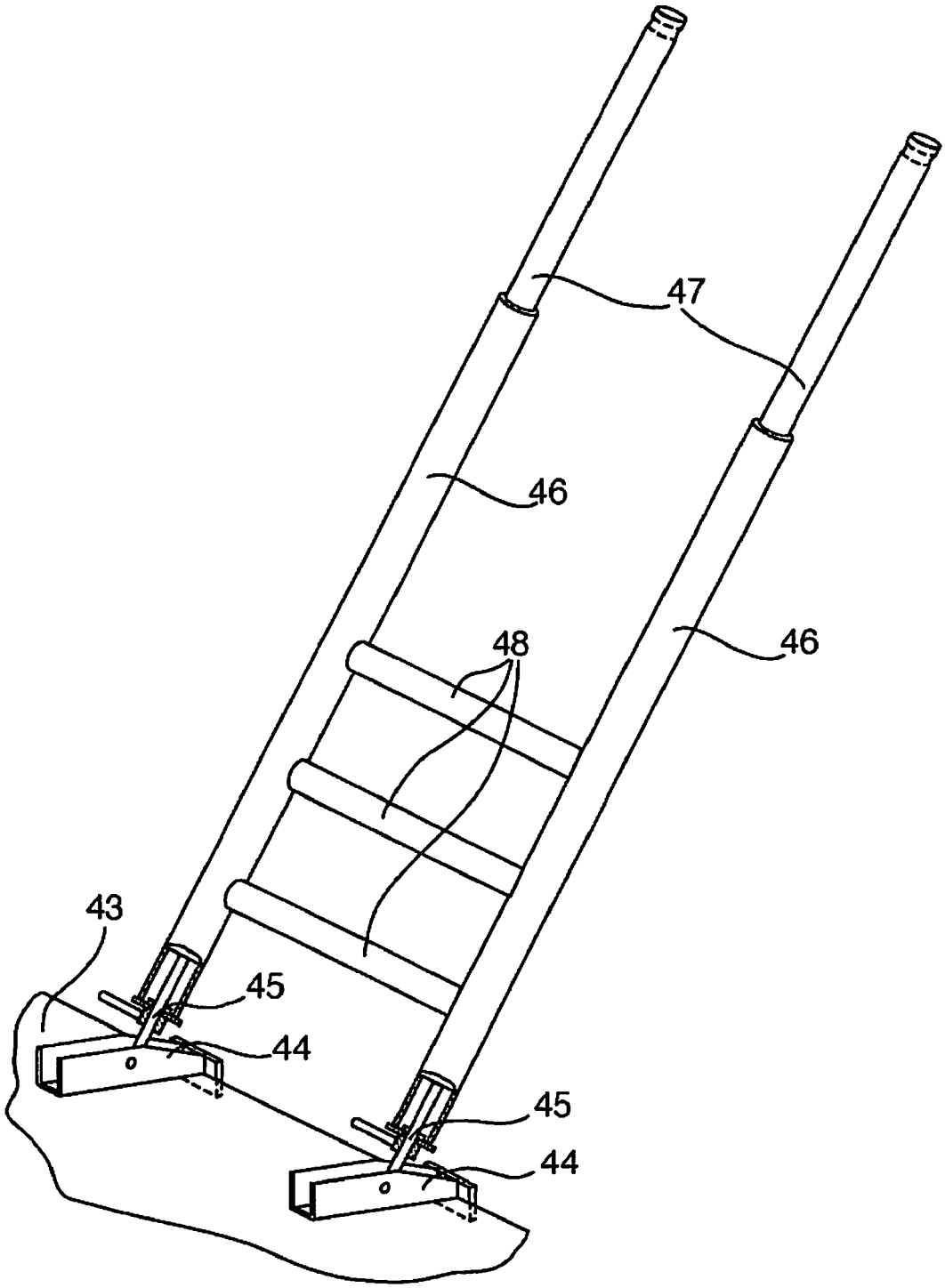
FIG. 18 is an isometric view of the raking shore assembly.
Figure 19:
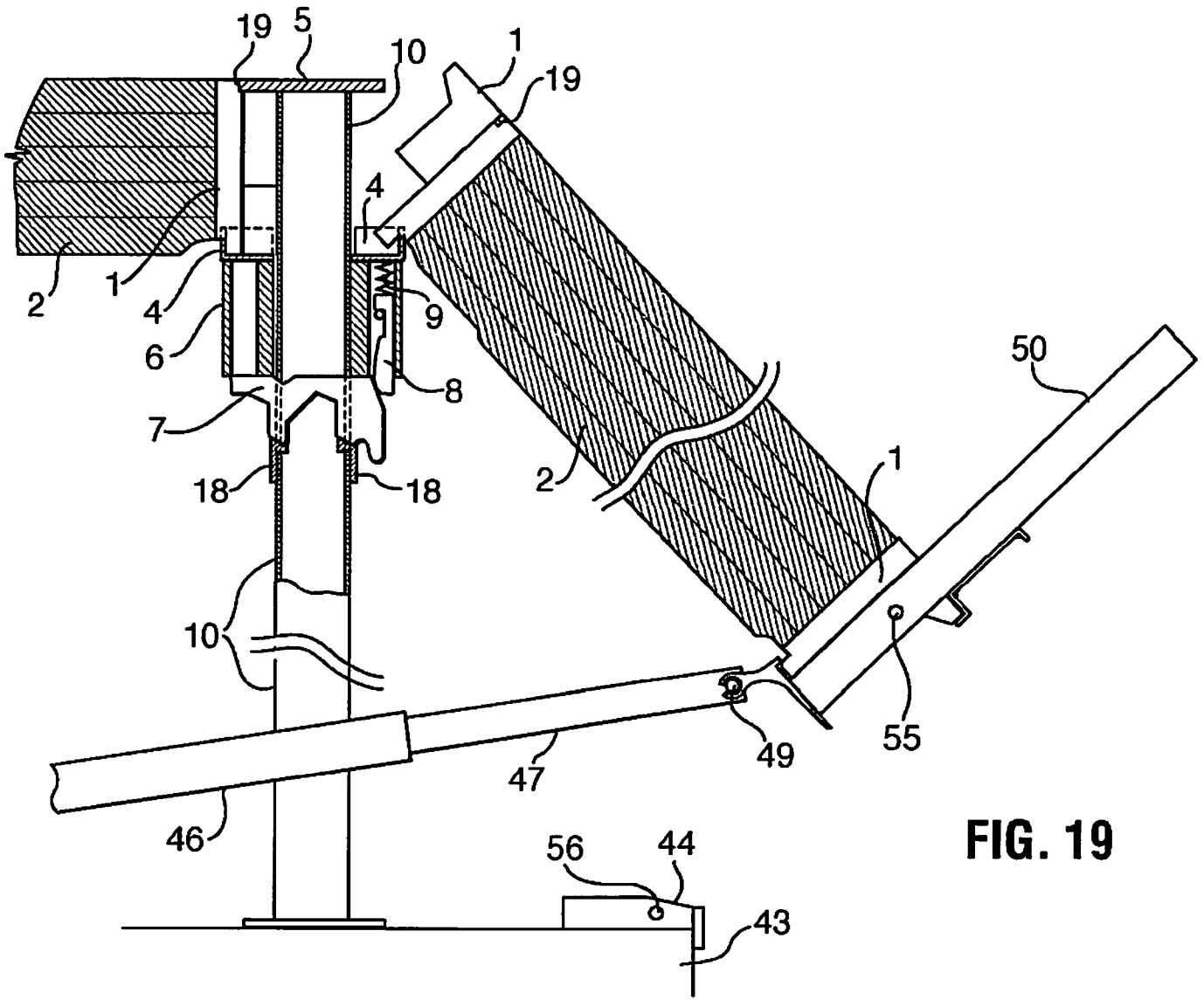
FIG. 19 is a side view showing the raking shore assembly attached to a form panel at the mid-point in the process of rotating into the pouring position.

The present invention further makes use of a raking shore assembly as shown in FIGS. 18 and 19. Members 46 and 47 are telescopic with member 47 sliding into member 46. Members 46 and 47 are pinned together at approximately the required length before erection commences. Two mounting shoes 44 are pre-installed at the edge of slab 43 before erection starts. Adjusting screws 45 are provided to give fine length adjustment. Rungs 48 act as a safety barrier.

Erection of the edge form panel starts with the hanging of the form panel on previously installed support posts 10. A safety barrier 50 in FIG. 19 is attached to the form panel with pin 55. The raking shore assembly is then attached via pin 49, as illustrated in FIG. 19, to the base of the safety barrier 50 on the hanging panel.

The raking shore could attach directly to the form panel. However some economy is gained by attaching to the safety barrier. The form panel is then rotated into the pouring position at which time the raking shore assembly is attached to shoe 44 by the installation of pin 56. FIG. 19 shows the arrangement of the system components mid-way in the process of moving the form panel into position.

Figure 20:
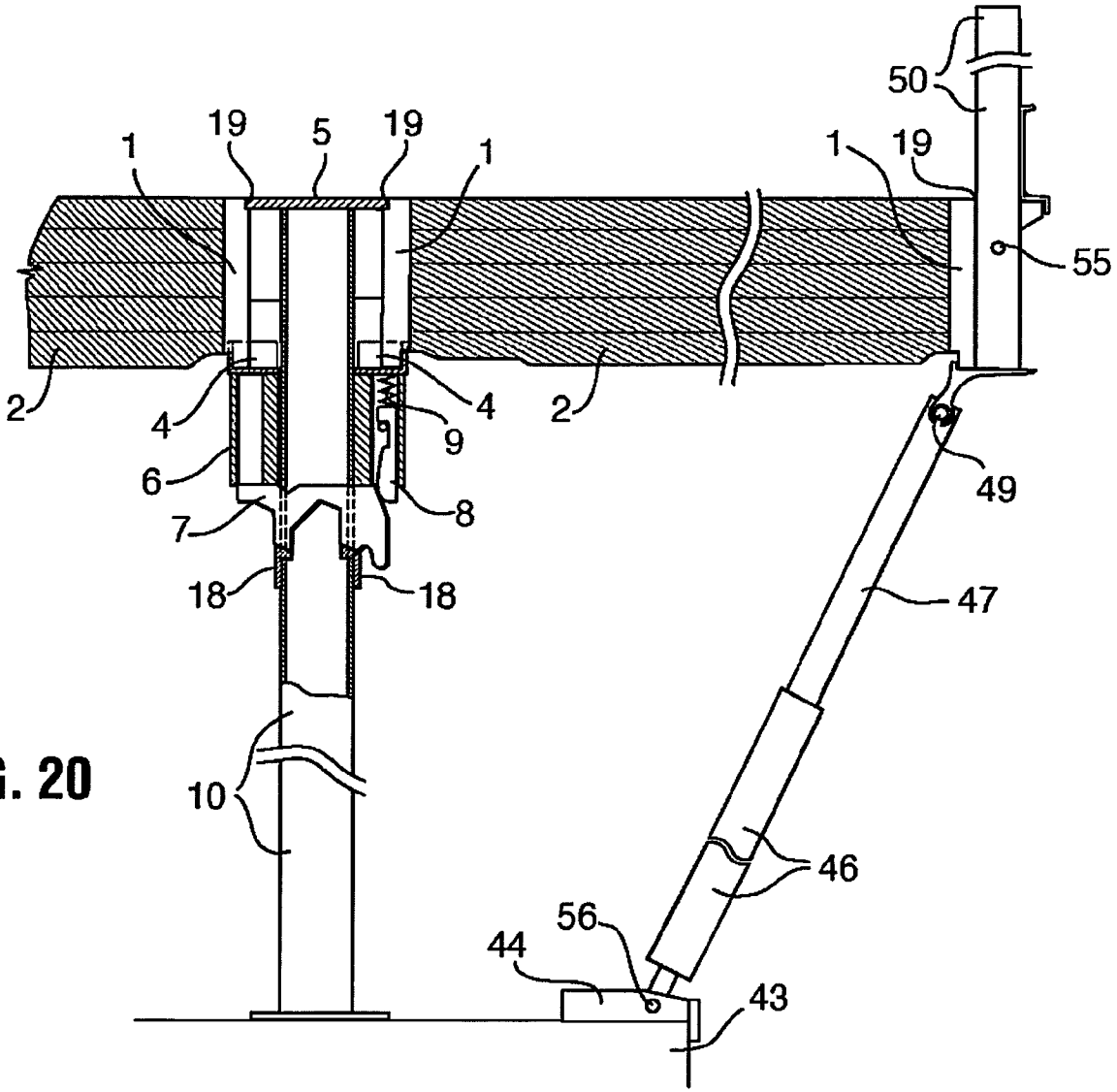
FIG. 20 is a side view of a raking shore installed in the pouring position.

FIG. 20 shows the completed installation from FIG. 19. One skilled in the art will note that at no time did workmen have to work beyond the edge of the completed slab or have to climb up to the form panel to make connections. The arrangement in FIGS. 19 and 20 shows the installation of a form panel that is rotated about the short side (end) of the form panel. An identical method is used to rotate form panels into position about the long side of the form panel. The same raking shore and safety barrier can be used in the process.

The above-described embodiments of the present invention are meant to be illustrative of preferred embodiments and are not intended to limit the scope of the present invention. Also, various modifications, which would be readily apparent to one skilled in the art, are intended to be within the scope of the present invention. The only limitations to the scope of the present invention are set forth in the following claims appended hereto.

The embodiments of the invention in which an exclusive property or priviledge is claimed are defined as follows:

1. A shoring post system for supporting one or more drop heads comprising: a shoring post having an outer surface, a hollow center and a gap therein; and a locking mechanism, wherein the locking mechanism comprises: a translating member fitting within the gap of the shoring post, the translating member comprising: an upper surface for supporting said one or more drop heads; and a plurality of legs extending downwardly from the upper surface and defining a space between said plurality of legs; and a seat, dimensioned to fit within the gap of said shoring post, wherein said translating member is laterally slidable from an engaged position where the plurality of legs are supported on the seat to a disengaged position where at least a portion of the seat fits into the space between the plurality of legs.

2. The locking mechanism of claim 1 further comprising a latch for holding said translating member in said engaged position.

3. The locking mechanism of claim 2, wherein said latch member is movable vertically from a lower holding position to an upper released position.

4. The locking mechanism of claim 3, wherein said mechanism includes a resilient biasing means, said resilient biasing means resiliently biasing said latch into said lower holding position.

5. The locking mechanism of claim 4, wherein said resilient biasing means is a compression spring.

6. The locking mechanism of claim 3 further comprising a pivoting staff operably coupled to said latch for repositioning the translating member from a locked to an unlocked position.

7. The locking mechanism of claim 2, wherein the lower surface of said translating member and said upper surface of said seat are angled to horizontal.

8. The locking mechanism of claim 7, wherein the angle of the lower surface is twenty-four degrees to the horizontal.

9. The locking mechanism of claim 1, wherein said locking mechanism includes two seats.

10. The locking mechanism of claim 9, wherein any one of said seats fits said gap between said translating member legs when said translating member is moved to said disengaged position.

11. The locking mechanism of claim 1, wherein the translating member includes a handle.

12. The locking mechanism of claim 11, wherein the handle comprises a downwardly extending projection extending beyond the outer surface of the shoring post.

13. The locking mechanism of claim 1, wherein the shoring post has a longitudinal axis and the translating member is translatable relative to the longitudinal axis.

14. The locking mechanism of claim 1, wherein the translating member is nonreciprocative.

* * * * *